US008330669B2

(12) United States Patent
Cornwall et al.

(10) Patent No.: US 8,330,669 B2
(45) Date of Patent: Dec. 11, 2012

(54) REMOTE ANTENNA COUPLING IN AN AMR DEVICE

(75) Inventors: Mark K. Cornwall, Spokane, WA (US); Junsong Lin, Veradale, WA (US)

(73) Assignee: Itron, Inc., Liberty Lake, WA (US)

( * ) Notice: Subject to any disclaimer, the term of this patent is extended or adjusted under 35 U.S.C. 154(b) by 432 days.

(21) Appl. No.: 12/765,142

(22) Filed: Apr. 22, 2010

(65) Prior Publication Data

US 2011/0260947 A1 Oct. 27, 2011

(51) Int. Cl.
*H01Q 1/50* (2006.01)

(52) U.S. Cl. ..... 343/906; 343/719

(58) Field of Classification Search ..... 343/719, 343/906; 340/870.02, 870.03
See application file for complete search history.

(56) References Cited

U.S. PATENT DOCUMENTS

| | | | |
|---|---|---|---|
| 4,387,296 | A | 6/1983 | Newell et al. |
| 4,588,856 | A | 5/1986 | Cohen |
| 4,633,486 | A | 12/1986 | Berlekamp et al. |
| 4,654,662 | A | 3/1987 | Van Orsdel |
| 4,737,797 | A | 4/1988 | Siwiak et al. |
| 4,744,004 | A | 5/1988 | Hammond |
| 4,780,910 | A | 10/1988 | Huddleston et al. |
| 4,800,393 | A | 1/1989 | Edward et al. |
| 4,804,957 | A | 2/1989 | Selph et al. |
| 4,825,220 | A | 4/1989 | Edward et al. |
| 4,904,995 | A | 2/1990 | Bonner et al. |
| 4,924,236 | A | 5/1990 | Schuss et al. |
| 5,010,568 | A | 4/1991 | Merriam et al. |
| 5,014,213 | A | 5/1991 | Edwards et al. |
| 5,111,407 | A | 5/1992 | Galpern |
| 5,270,639 | A | 12/1993 | Moore |
| 5,448,230 | A | 9/1995 | Schanker et al. |
| 5,486,755 | A | 1/1996 | Horan et al. |
| 5,519,387 | A | 5/1996 | Besier et al. |
| 5,541,589 | A | 7/1996 | Delaney |
| 5,553,094 | A | 9/1996 | Johnson et al. |
| 5,617,084 | A | 4/1997 | Sears |
| 5,659,300 | A | 8/1997 | Dresselhuys et al. |
| 5,678,201 | A | 10/1997 | Thill |
| 5,708,446 | A | 1/1998 | Laramie |
| 5,711,675 | A | 1/1998 | Nishitani et al. |
| 5,719,564 | A | 2/1998 | Sears |

(Continued)

FOREIGN PATENT DOCUMENTS

| | | |
|---|---|---|
| CN | 2247819 | 2/1997 |

(Continued)

OTHER PUBLICATIONS

Automated translation of Abstract of JP 8126085.

(Continued)

*Primary Examiner* — Anh Tran
(74) *Attorney, Agent, or Firm* — Dority & Manning, P.A.

(57) ABSTRACT

Disclosed are apparatus and methodology for providing improved signal radiation from an Automatic Meter Reading (AMR) endpoint module. A two-part coupler is provided, with one part thereof affixed to a printed circuit board (PCB) which hosts components of an endpoint module including a transmitter to which, via the two-part coupler, various antenna may be selectively connected to improve signal radiation from the module. The antenna coupling system provides a selection of various antennae including some directly connected to a component of the two-part coupler and others connected remotely to the two-part coupler by way of a cable.

22 Claims, 2 Drawing Sheets

U.S. PATENT DOCUMENTS

| | | | |
|---|---|---|---|
| 5,801,643 | A | 9/1998 | Williams et al. |
| 5,808,558 | A | 9/1998 | Meek et al. |
| 5,826,195 | A | 10/1998 | Westerlage et al. |
| 5,847,683 | A | 12/1998 | Wolfe et al. |
| 5,892,758 | A | 4/1999 | Argyroudis |
| 5,896,097 | A | 4/1999 | Cardozo |
| 5,909,640 | A | 6/1999 | Farrer et al. |
| 5,914,673 | A | 6/1999 | Jennings et al. |
| 5,966,010 | A | 10/1999 | Loy et al. |
| 5,986,574 | A | 11/1999 | Colton |
| 5,995,593 | A | 11/1999 | Cho |
| 6,014,089 | A | 1/2000 | Tracy et al. |
| 6,016,432 | A | 1/2000 | Stein |
| 6,067,052 | A | 5/2000 | Rawles et al. |
| 6,069,571 | A | 5/2000 | Tell |
| 6,078,785 | A | 6/2000 | Bush |
| 6,150,955 | A | 11/2000 | Tracy et al. |
| 6,208,266 | B1 | 3/2001 | Lyons et al. |
| 6,222,503 | B1 | 4/2001 | Gietema et al. |
| 6,246,677 | B1 | 6/2001 | Nap et al. |
| 6,300,907 | B1 | 10/2001 | Lazar et al. |
| 6,411,219 | B1 | 6/2002 | Slater |
| 6,650,249 | B2 | 11/2003 | Meyer et al. |
| 7,446,672 | B2 * | 11/2008 | Johnson et al. ..... 340/870.02 |
| 2010/0110617 | A1 * | 5/2010 | Savage et al. ..... 361/659 |

FOREIGN PATENT DOCUMENTS

| | | |
|---|---|---|
| CN | 1163404 | 10/1997 |
| JP | 8126085 | 5/1996 |
| WO | WO 96/39753 | 12/1996 |
| WO | WO 98/10299 | 3/1998 |
| WO | WO 2005/094154 | 10/2005 |

OTHER PUBLICATIONS

Automated translation of Abstract of CN 2247819.

Automated translation of Abstract of CN 1163404.

Simon Guy and Simon Marvin, "Pathways to 'Smarter' Utility Meters: the Socio-technical Shaping of New Metering Technologies," pp. 1-41, Nov. 1995, School of Architecture, Planning & Landscape, Global Urban Research Unit, Centre for Urban Technology, University of Newcastle upon Tyne.

Ron A. Haberkorn and Paul E. Nikolich, "Driving Forces in Wireless Data Communications," pp. 39-47, 1Q1996, New Telecom Quarterly, Technology Futures, Inc.

* cited by examiner

REMOTE ANTENNA COUPLING IN AN AMR DEVICE

FIELD OF THE INVENTION

The present subject matter relates to Automatic Meter Reading (AMR) technology. More particularly, the present subject matter relates to antennae and antenna coupling arrangements for use with utility meters operating in a wireless meter-reading environment.

BACKGROUND OF THE INVENTION

Automatic Metering Reading (AMR) endpoints and particularly water endpoints generally operate in relatively harsh environments. Often designers try to insulate electronic components from such environment by encapsulating them in plastic or in potting material. Because of such frequent approach, antenna components are often integrated onto the same circuit board and potted along with the other endpoint components. Integrating the antenna with the electronics also reduces cost since the same circuit board that holds the components can also serve as the antenna.

In cases where the endpoint needs to be located in a difficult location, a remote antenna can be used to re-radiate the RF energy to a more desirable location. Such approach poses a problem, however, because coupling efficiency of the remote antenna to the internal antenna is not very good. In fact, in some instances, losses may be 5 dB or more.

Various antenna related prior publications exist, including U.S. Pat. No. 6,650,249 to Meyer et al. disclosing a "Wireless Area Network Communications Module For Utility Meters;" U.S. Pat. No. 6,300,907 to Lazar et al. disclosing an "Antenna Assembly For Subsurface Meter Pit;" U.S. Pat. No. 5,111,407 to Galpern disclosing a "System For Measuring And Recording A Utility Consumption;" WO Publication 2005/094154 by Kam-Strup A/S disclosing a "Method And Device For Detecting An External Antenna."

While various implementations of Automatic Meter Reading systems have been developed, and while various combinations of endpoint associated antennae have been provided, no design has emerged that generally encompasses all of the desired characteristics as hereafter presented in accordance with the subject technology.

SUMMARY OF THE INVENTION

In view of the recognized features encountered in the prior art and addressed by the present subject matter, an improved remote antenna coupler system for use in an Automatic Meter Reading (AMR) environment has been provided.

One present exemplary arrangement may include a male coupler portion having a first portion configured for attachment to a printed circuit board and a second portion coupled to and extending above said first portion, a plurality of female coupler portions each having a capture portion configured to mate with the second portion of the male coupler portion and a second portion coupled to and extending above the capture portion, and a plurality of diverse antennae structures associated individually with each of the plurality of female coupler portions. With such an arrangement, a selected combination of one of the plurality of diverse antennae structures and female coupler portions may advantageously be interchangeably coupled to the male coupler portion.

In certain present exemplary systems, the male coupler portion may comprise a first cylindrical portion and a second rectangular portion, while in alternative present exemplary systems the male coupler portion may comprise a first cylindrical portion having a first diameter and a second cylindrical portion having a second diameter less than that of the first cylindrical portion.

In other present particular exemplary systems, at least one of the plurality of diverse antennae structures may comprise a linear extension of the second portion of the female coupler portion. In other present particular exemplary systems, at least one of the plurality of diverse antennae structures may comprise a quarter-wave length wire coupled to the second portion of the female coupler portion.

In further particular exemplary systems of the present subject matter, a remote antenna structure and a length of cable may be provided with the length of cable coupled between the remote antenna and the second portion of the female coupler portion, so that per present subject matter the remote antenna structure may be placed at a distance from the female coupler portion in accordance with the cable length.

Still further, in selected present exemplary systems, an impedance matching network may be coupled between the remote antenna structure and the length of cable.

The present subject matter also equally relates to an endpoint module for use in an AMR environment comprising such as a printed circuit board, a remote antenna coupler, and a protective coating. With such an arrangement, preferably the remote antenna coupler may comprise a male coupler portion attached to the printed circuit board and further comprise a female coupler portion having a capture portion configured to mate with the male coupler portion and a second portion configured to be coupled to an antenna structure. Preferably in such arrangements, the protective coating at least partially covers the printed circuit board and at least a portion of the male coupler portion of the remote antenna coupler.

It is to be understood that in various present alternative arrangements of the foregoing embodiment, the designated "male coupler portion" may be attached to the antenna structure, while the designated "second portion" (associated with the female coupler portion) may be associated with the printed circuit board. Likewise, the designations "male" and "female" are not intended to insinuate any particular mechanical structures, but to more broadly convey the concept of using interlocking or otherwise cooperating or mating complementary mechanical structures.

In particular present exemplary embodiments, the present protective coating covers at least a portion of the second portion of the female coupler portion of the remote antenna coupler.

In further present exemplary embodiments, an antenna element may be coupled to the second portion of a female coupler portion of a present remote antenna coupler. In certain of such embodiments, the antenna element may comprise a quarter-wave length wire coupled to the second portion of the female coupler portion.

In certain particular present exemplary embodiments, a cable may be used to connect a remote antenna structure to the second portion of the female coupler portion. In selected such embodiments, an impedance matching network may be coupled in line between the remote antenna and cable.

The preset subject matter also equally relates to corresponding methodology. One present example relates to a method for selectively enhancing radio frequency (RF) communications from an endpoint module in an AMR environment. Such exemplary method may preferably comprise providing an endpoint module having at least a transmitter portion, providing a remote antenna coupler having a male coupler portion and a mating female coupler portion, coupling the male coupler portion to the transmitter portion of the endpoint module, providing an antenna element, coupling the antenna element to the female coupler portion, and coupling the female coupler portion to the male coupler portion. As broadly referenced above, it is to be understood that the relative positions of the designaed "male" and "female" components may be reversed in various present embodiments, including in present methodologies.

In some present exemplary embodiments, methodology of the present subject matter also provides for using a cable to couple the antenna element to the female coupler portion.

In specific present exemplary embodiments, an impedance matching network may also be inserted between the cable and the remote antenna.

In other present examples, a method in accordance with the present subject matter provides for using a quarter-wave length antenna element directly coupled to the female coupler portion.

In still further particular present embodiments, an exemplary method may provide environmental protection by coating at least a portion of the endpoint module and the male coupler portion in a protective coating, and in some instances also coating at least a portion of the endpoint module and the female coupler portion in a protective coating.

In selected embodiments of the present subject matter, the method provides for providing a remote antenna coupler having rectangular mating male and female coupler portion.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the present subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
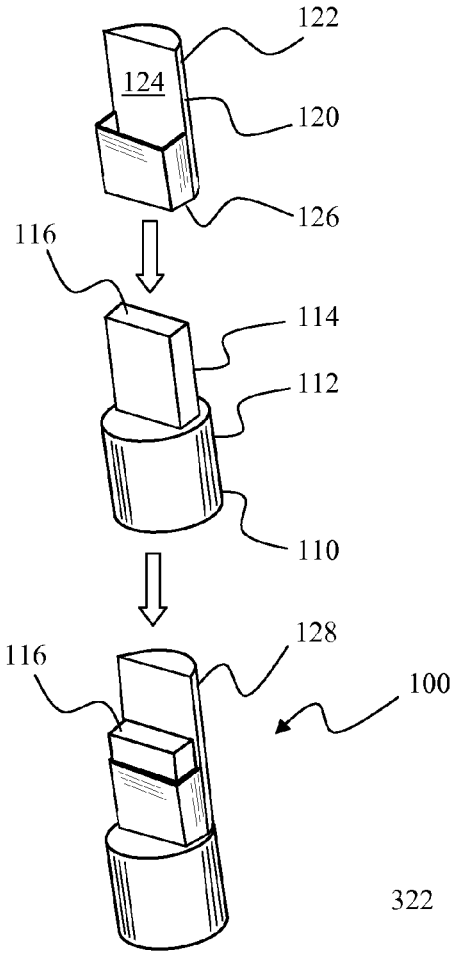
FIG. 1 illustrates a coupler constructed in accordance with present technology in both separated and coupled views thereof.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with antenna and antenna couplers for use with AMR endpoints.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Reference will now be made in detail to exemplary presently preferred embodiments of the subject remote antenna coupler. The present subject matter in certain embodiments thereof corresponds to a low loss antenna coupling mechanism and multiple associated antenna configurations adapted to couple radio frequency (RF) energy from an AMR endpoint to the air. In general, a principle of the present technology is to provided a generic (our "universal") AMR endpoint module with an internal sealed RF coupler and a selection of snap on antennae of different configurations that may be attached to the outside of the module.

In accordance with present technology, an efficient RF coupler has been developed that minimizes loss and provides a variety of snap on antenna configurations to facilitate improved response to a variety of endpoint installation environments. Referring now to the drawings, FIG. 1 illustrates a coupler generally 100 constructed in accordance with present technology, and as shown in both separated and coupled views. As may be seen, coupler 100 corresponds to a two-piece construction including a male coupler portion 110 and a female coupler portion 120.

Male coupler portion 110 may be configured to be associated such as with an AMR endpoint and, in an exemplary embodiment, may be secured by way of lower cylindrical portion 112 to a presently unillustrated printed circuit board (PCB) that itself may support some or all of the electrical components forming the endpoint. In an exemplary configuration, the lower cylindrical portion 112 of male type coupler portion 110 may be soldered to the same PCB supporting the endpoint electronics. In such regard, the lower cylindrical portion 112 of male coupler portion 110 may be at least partially encased in any protective plastic or potting material used to protect the endpoint circuitry. In certain instances, following attachment of an appropriate female couple portion 120, both coupler components may be encased in protective plastic or potting material. Such relationships and aspects of various components to a PCB are described more fully herein with reference to present FIG. 6.

In the exemplary configuration illustrated in present FIG. 1, male coupler portion 110 includes a generally upstanding rectangular portion 114 configured to mate with female coupler portion 120. More specifically, female coupler portion 120 includes an upper portion corresponding generally to a vertical portion of a solid cylinder 122 having a flat surface 124 and a capture portion 126. Capture portion 126 is configured as an open rectangular box having sides, one of which corresponds in part to the previously noted flat surface 124.

In accordance with present technology, the present exemplary configuration of flat surface 124 and a mating flat surface on the rear (unseen) side of upstanding rectangular portion 114 of male coupler portion 110 provide per present subject matter for a low loss coupling of RF signals between the two portions 110, 120 of coupler 100. In addition, capture portion 126 of female coupler portion 120 is configured to surround and firmly retain the upstanding rectangular portion 114 of male coupler portion 110.

With further reference to FIG. 1, it will be noted that flat surface 124 of solid cylinder portion 122 of female coupler portion 120 includes an extended portion 128 that extends slightly above a top portion 116 of upstanding rectangular portion 114 of male coupler portion 110. In such present exemplary configuration, extended portion 128 may itself function as an antenna element in certain instances. Alternative antenna configurations, however, in accordance with present technology are otherwise described herein more particularly with reference to FIGS. 3-5.

Figure 2:
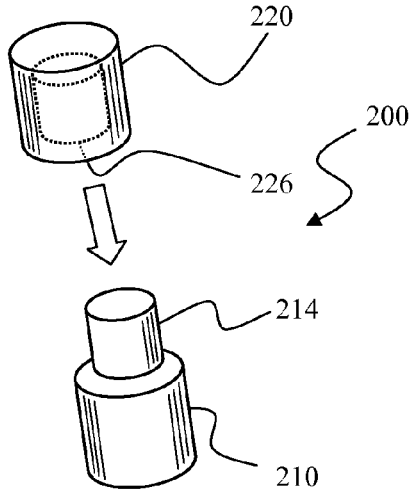
FIG. 2 illustrates an alternate configuration for portions of the two-part coupler in accordance with present technology.

With reference to present FIG. 2, there is illustrated an alternate configuration for a two-part coupler generally 200 in accordance with present technology. As may be seen in such illustrated embodiment, the male portion 210 of two-part coupler 200 corresponds to a dual cylindrical configuration such that an upstanding portion 214 thereof is also configured in a cylindrical arrangement but with a smaller diameter than the supporting lower cylinder portion. In such present exemplary configuration, the female portion of the coupler 220 may correspond to a hollowed cap type structure with a hollowed portion 226 configured to securely fit over and surround upstanding portion 214.

As will be appreciated by those of ordinary skill in the art, radio frequency (RF) signals tend to propagate over the surface of a conductor. By providing a larger area of contact between the mating surfaces of the two-part couplers 100, 200 in accordance with present technology, significant relative reduction in signal loss may be achieved.

Figure 3:
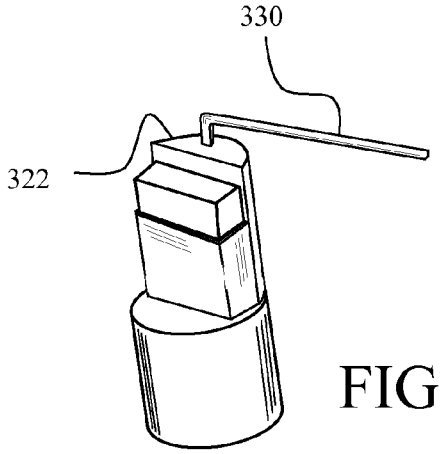
FIG. 3 illustrates an alternative embodiment of a two-part coupler including an affixed antenna, in accordance with present technology.

With reference to FIG. 3, there is illustrated an alternative embodiment of a present exemplary two-part coupler configured such that female coupler portion 322 thereof is somewhat shorter that that illustrated in FIG. 1, but also has attached thereto an antenna element 330. As is represented by present FIG. 3, antenna element 330 may be attached at one end thereof to the top portion of female coupler portion 322. In other preferred exemplary arrangements, antenna element 330 may be configured with a right-angled bend in relatively close proximity to the point at which such antenna element 330 is secured to the female coupler portion 322. Such right-angled bend may be provided to accommodate placement of an AMR endpoint incorporating the present remote antenna coupling technology in those instances where the endpoint may be placed in a relatively confining area.

Figure 4:
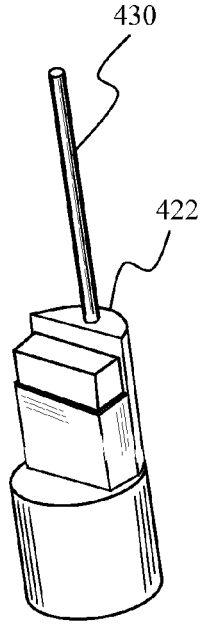
FIG. 4 illustrates another alternative embodiment of a two-part coupler including an affixed antenna, in accordance with present technology.

In yet a further present alternative configuration as illustrated in FIG. 4, antenna element 430 may be similarly attached to a top portion of female coupler portion 422 but in such embodiment is configured as a straight antenna element. In both cases, antenna elements 330, 430 may correspond to a tuned element corresponding to, for example, a quarter wavelength ($\lambda/4$) antenna element tuned to the operating frequency of the endpoint. Of course, other appropriate wavelength antenna elements may be employed, all in accordance with the present technology. Generally per the present subject matter, an antenna may be chosen to provide signal gain to compensate for losses resulting from a below ground or other signal impeding installation.

Figure 5:
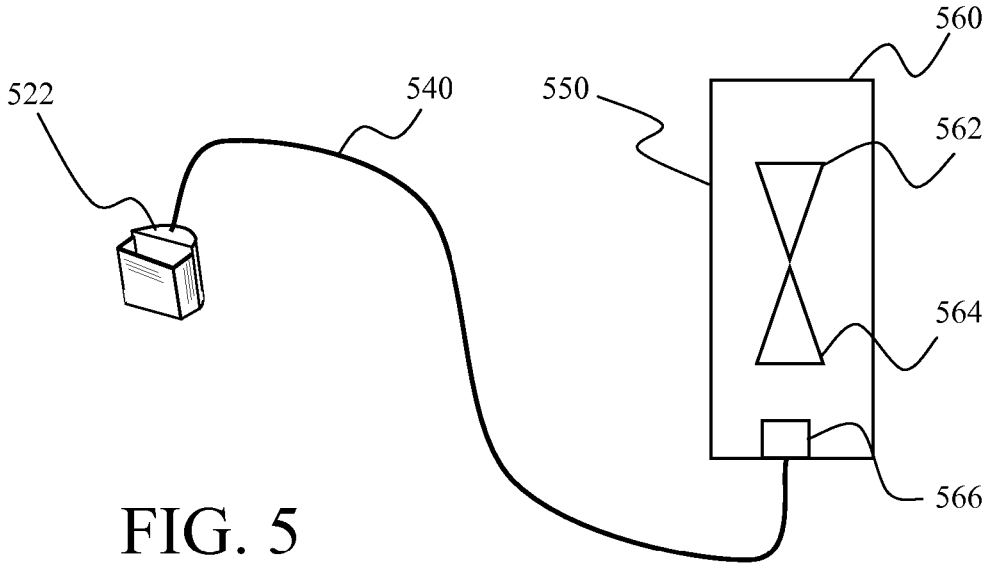
FIG. 5 illustrates a remotely positionable antenna configuration in accordance with present technology, and where the two-part coupler and antenna may be separated by a connecting cable.

With reference to present FIG. 5, an additional exemplary embodiment of the present subject matter is illustrated and described. As may be seen from such FIG. 5, the present subject matter contemplates a further exemplary configuration where the antenna generally 550 may be located at a distance from the endpoint. In such configuration, female coupler portion 522 of the two-part coupler may be connected to antenna 550 by way of a wire 540. Wire 540 may correspond to a coaxial cable or other suitable RF conducting cable, as well understood by those of ordinary skill in the art without requiring additional explanation.

Exemplary antenna 550 is preferably configured so as to be selectively mounted at a location to permit effective signal radiation. In such regard, antenna 550 may include a support substrate 560 on which are mounted radiating antenna elements 562, 564, as well as an optional impedance matching circuit 566 coupled between cable 540 and antenna elements 562, 564.

Further, as will be understood by those of ordinary skill in the art, antenna 550 may be encased in whole or in part in a plastic or potting material for environmental protection purposes. It should be appreciated that while FIG. 5 illustrates what appears to be a "bow-tie" type antenna configuration, such is for illustration purposes only and while such an antenna type may be employed such illustration is not intended as a specific limitation of the present technology.

Figure 6:
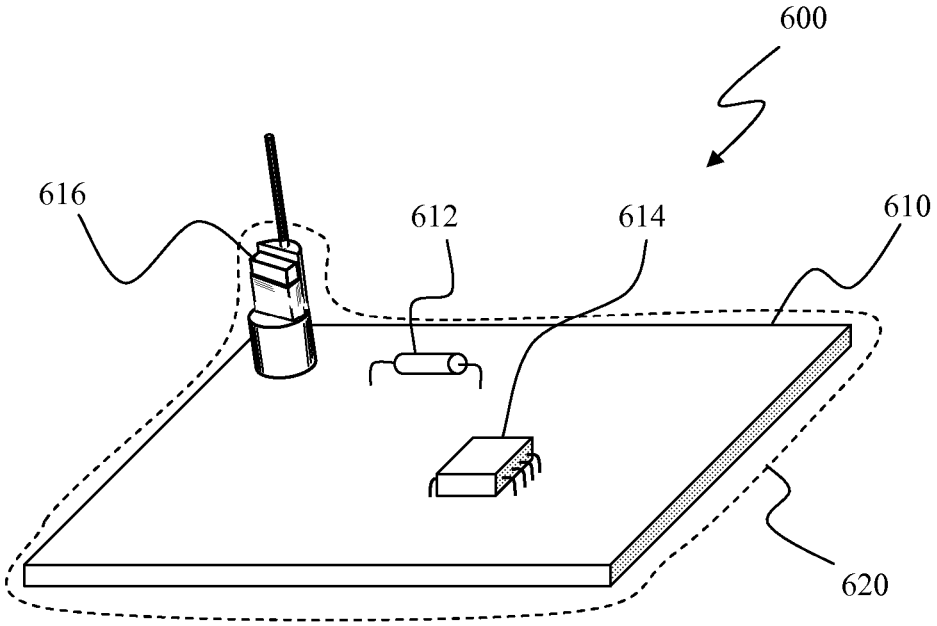
FIG. 6 illustrates an exemplary endpoint circuit board incorporating a two-part coupler and antenna configuration in accordance with present disclosure.

With reference to present FIG. 6, there is illustrated an exemplary endpoint circuit board generally 600 incorporating the present technology. As shown, endpoint circuit board 600 includes a supporting substrate corresponding to printed circuit board (PCB) 610 configured to support and interconnect endpoint components including components 612, 614 and at least the male portion of an exemplary present two-part antenna coupler 616. In the subject representative illustration, at least some of the supported components form a transmitter circuit to which at least the male portion of the two-part coupler is connected.

In the exemplary embodiment and configuration with present subject matter as illustrated in present FIG. 6, the male portion of two-part antenna coupler 616 has been mounted to PCB 610, an appropriate antenna 630 has been affixed to the female portion of two-part coupler 616, and both the male and female portions as well as an end portion of antenna 630 have been potted in place by potting material 620 along with the other components 612, 614 mounted to PCB 610. As previously noted, however, alternatively, potting material 620 may be provided only covering a portion of the male portion of two-part coupler 616 such that alternate antenna choices may be made following potting of the endpoint.

Those of ordinary skill in the present art will appreciate that exemplary endpoint 600 may be incorporated into a meter module. In certain instances, such meter modules may be installed in a pit and may be located as deep as 3 to 4 feet below local surface level. Generally, such endpoints may be required to transmit at a relatively higher power level just to overcome losses due to their location. When water is added to the equation, since many pits for water meters fill with water, there is even more attenuation.

If an antenna can be located closer to a pit lid, attenuation from water pit and pit depth is minimized. Further radio frequency coupling mechanisms previously employed introduce significant losses on their own. Such losses increase the transmitter power required to overcome the losses, and often at the additional cost of a decrease in battery life. The present subject matter addresses such issues by providing a significant improvement in antenna coupling along with the capability to provide varying levels of antenna gain and location positioning capabilities.

While the present subject matter has been described in detail with respect to specific embodiments thereof, it will be appreciated that those skilled in the art, upon attaining an understanding of the foregoing may readily produce alterations to, variations of, and equivalents to such embodiments. For example, much of the present disclosure relates the subject coupling mechanism as being a so-called or designated male coupler associated with an endpoint side, while having a designated female coupler on the antenna side. It is to be understood that the relative positions in a given embodiment may be reversed, so that the designated female coupler is associated with an endpoint side while the designated male coupler is associated with the antenna side. Likewise, common use of gender-based terminology herein is not intended to insinuate limitations as to particular mechanical structures; rather, various interlocking, cooperating, or mating mechanical arrangements may be practiced in accordance with the broader aspects of the present subject matter.

Accordingly, the scope of the present disclosure is by way of example rather than by way of limitation, and the subject disclosure does not preclude inclusion of such modifications, variations and/or additions to the present subject matter and appended claims as would be readily apparent to one of ordinary skill in the art.

What is claimed is:

1. A remote antenna coupler system for use in an Automatic Meter Reading (AMR) environment, comprising;

a male coupler portion, having a first portion configured for attachment to a printed circuit board, and having a second portion coupled to and extending above said first portion;

a plurality of female coupler portions, each respectively having a capture portion configured to mate with said second portion of said male coupler portion, and each respectively having a second portion coupled to and extending above said capture portion thereof; and a plurality of diverse antennae structures associated individually with each of said plurality of female coupler portions, whereby a selected combination of one of the plurality of diverse antennae structures and female coupler portions may be interchangeably coupled to said male coupler portion.

2. A system as in claim 1, wherein said male coupler portion comprises a first cylindrical portion and a second rectangular portion.

3. A system as in claim 1, wherein said male coupler portion comprises a first cylindrical portion having a first diameter and a second cylindrical portion having a second diameter less than that of the first cylindrical portion.

4. A system as in claim 1, wherein at least one of the plurality of diverse antennae structures comprises a linear extension of said second portion of said female coupler portion.

5. A system as in claim 1, wherein at least one of the plurality of diverse antennae structures comprises a quarter-wave length wire coupled to said second portion of said female coupler portion.

6. A system as in claim 1, further comprising:

a remote antenna structure; and a length of cable;

wherein said length of cable is coupled between said remote antenna and said second portion of said female coupler portion;

whereby said remote antenna structure may be placed at a distance from said female coupler portion in accordance with the cable length.

7. A system as in claim 6, further comprising an impedance matching network coupled between said remote antenna structure and said length of cable.

8. An endpoint module for use in an AMR environment, comprising:

a printed circuit board;

a remote antenna coupler; and a protective coating;

wherein said remote antenna coupler comprises a male coupler portion attached to one of said printed circuit board and an antenna structure, and comprises a female coupler portion having a capture portion configured to mate with said male coupler portion, and a second portion thereof configured to be coupled to the other of said printed circuit board and an antenna structure; and wherein said protective coating at least partially covers said printed circuit board and at least a portion of the male coupler portion of said remote antenna coupler.

9. A module as in claim 8, wherein said male coupler portion is attached to said printed circuit board, and said second portion of said female coupler portion is configured to be coupled to an antenna structure.

10. A module as in claim 9, wherein said protective coating covers at least a portion of said second portion of said female coupler portion of said remote antenna coupler.

11. A module as in claim 9, further comprising an antenna element coupled to said second portion of said female coupler portion of said remote antenna coupler.

12. A module as in claim 11, wherein said antenna element comprises a quarter-wave length wire coupled to said second portion of said female coupler portion.

13. A module as in claim 11, further comprising:

a cable; and wherein said antenna element comprises a remote antenna structure coupled to said second portion of said female coupler portion by way of said cable.

14. A module as in claim 13, further comprising an impedance matching network coupled between said remote antenna structure and said cable.

15. A method for selectively enhancing radio frequency (RF) communications from an endpoint module in an AMR environment, comprising:

providing an endpoint module having at least a transmitter portion;

providing a remote antenna coupler having a male coupler portion and a mating female coupler portion;

providing an antenna element;

coupling the male coupler portion to one of the transmitter portion of the endpoint module and the antenna element;

coupling the female coupler portion to the other of the transmitter portion of the endpoint module and the antenna element; and coupling the female coupler portion to the male coupler portion.

16. A method as in claim 15, further including:

coupling the male coupler portion to the transmitter portion of the endpoint module; and coupling the female coupler portion to the antenna element.

17. A method as in claim 16, further comprising:

providing a cable; and wherein coupling the antenna element to the female coupler portion comprises coupling the antenna element to the female coupler portion by way of the cable.

18. A method as in claim 17, further comprising providing an impedance matching network between the antenna element and the cable.

19. A method as in claim 16, wherein:

providing an antenna element comprises providing a quarter-wave length antenna element; and coupling the antenna element to the female coupler portion comprises directly coupling the antenna element to the female coupler portion.

20. A method as in claim 16, further comprising coating at least a portion of the endpoint module and the male coupler portion in a protective coating.

21. A method as in claim 16, further comprising coating at least a portion of the endpoint module and the female coupler portion in a protective coating.

22. A method as in claim 16, wherein providing a remote antenna coupler comprises providing a remote antenna coupler having rectangular mating male and female coupler portions.

* * * * *